US011434062B2

(12) United States Patent
Le Reverend et al.

(10) Patent No.: US 11,434,062 B2
(45) Date of Patent: Sep. 6, 2022

(54) LIQUID DISPENSING APPARATUS

(71) Applicant: SOCIETE DES PRODUITS NESTLE S.A., Vevey (CH)

(72) Inventors: Benjamin Le Reverend, Kirkwood, MO (US); Heiko Oertling, Lausanne (CH); Beat Gerber, Moudon (CH)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 16/624,145

(22) PCT Filed: Jun. 19, 2018

(86) PCT No.: PCT/EP2018/066194
§ 371 (c)(1),
(2) Date: Dec. 18, 2019

(87) PCT Pub. No.: WO2018/234276
PCT Pub. Date: Dec. 27, 2018

(65) Prior Publication Data

US 2020/0172316 A1 Jun. 4, 2020

(30) Foreign Application Priority Data

Jun. 21, 2017 (EP) ..... 17177207

(51) Int. Cl.
*B65D 81/32* (2006.01)

(52) U.S. Cl.
CPC ..... *B65D 81/3216* (2013.01)

(58) Field of Classification Search
CPC .... B65D 81/3216; B65D 21/086; B65D 1/24; B65D 81/3222; B65D 25/0897; B65D 1/04
(Continued)

(56) References Cited

U.S. PATENT DOCUMENTS 2,533,806 A * 12/1950 Holzapfel ..... B65D 25/087 206/221
3,729,114 A * 4/1973 Mari ..... A47G 7/06 220/504
(Continued)

FOREIGN PATENT DOCUMENTS

JP S61183864 U 11/1986
JP 3051994 U 9/1998
(Continued)

OTHER PUBLICATIONS

Japan Patent Office Communication for Application No. 2019-569445, Dispatch No. 221316, dated May 17, 2022, 8 pages.

*Primary Examiner* — Shawn M Braden
(74) *Attorney, Agent, or Firm* — K&L Gates LLP

(57) ABSTRACT

A liquid dispensing apparatus, may include a first container configured to hold a first liquid. The first container can have an opening in an end of the first container. The liquid dispensing apparatus may further comprise a frustoconical-shaped container inside and attached to the first container. The frustoconical-shaped container is configured to hold a second liquid. A frustum of the frustoconical-shaped container has an opening. The frustum of the frustoconical-shaped container is proximate to the end of the first container and the opening in the frustoconical-shaped container may have a smaller cross-sectional area than the opening in the first container. The frustoconical-shaped container separates the first liquid from the second liquid. When the first and the second liquids are poured from the apparatus, the first liquid flows through the opening in the first container, the second liquid flows through the opening in the frustoconical-shaped container and the opening in the first container, such that the
(Continued)

first liquid begins to exit the opening in the first container before the second liquid begins to exit the opening in the first container.

12 Claims, 9 Drawing Sheets

(58) Field of Classification Search
USPC ..... 215/6, 11.1, 11.4, 398; 220/23.8, 502, 220/504, 505, 506, 608, 23; 206/219, 206/221, 306, 459, 47
See application file for complete search history.

(56) References Cited

U.S. PATENT DOCUMENTS 3,741,383 A * 6/1973 Wittwer ..... B65D 81/3216 206/219
3,856,138 A * 12/1974 Maekawa ..... B65D 81/3222 206/221
4,410,085 A * 10/1983 Beneziat ..... B65D 81/3216 206/217
5,215,214 A * 6/1993 Lev ..... B65D 81/3216 220/502
5,487,486 A * 1/1996 Meneo ..... A47G 19/127 215/398
6,022,134 A * 2/2000 Andrews ..... B01F 13/002 206/221
7,165,697 B1 * 1/2007 Checkalski ..... A47G 19/2205 215/6
7,299,936 B2 * 11/2007 Singh ..... B65D 81/3227 206/499
8,015,915 B2 * 9/2011 Poissant ..... C12G 1/0206 99/277.1
8,083,056 B1 * 12/2011 Wu ..... B65D 81/3222 206/221
8,104,611 B2 * 1/2012 Helou, Jr. ..... B65D 81/3222 206/219
8,763,835 B2 * 7/2014 Tirone ..... F25D 3/08 220/23.87
8,881,920 B1 * 11/2014 Bral ..... A61C 17/02 215/6
9,114,910 B1 * 8/2015 Schommer ..... B65D 77/0493
9,783,358 B2 * 10/2017 Dhand ..... B65D 81/3222
9,855,571 B2 * 1/2018 Camilleri ..... B65D 25/54
2009/0294397 A1 * 12/2009 Wu ..... B65D 81/3222 215/6
2011/0192734 A1 * 8/2011 Helou, Jr. ..... B65D 81/3222 206/219
2013/0295224 A1 * 11/2013 Dijksterhuis ..... A23G 9/32 426/2
2015/0189904 A1 * 7/2015 Prakash ..... A23L 27/88 426/74
2016/0295880 A1 * 10/2016 Edara ..... A23G 9/36

FOREIGN PATENT DOCUMENTS

WO 0040469 7/2000
WO 2007053972 5/2007

* cited by examiner

LIQUID DISPENSING APPARATUS

FIELD

The present teachings relate to a liquid dispensing apparatus and in particular but not exclusively to a liquid dispensing apparatus for dispensing different liquids.

BACKGROUND

There is interest in being able to enhance the taste perception of tastants such as sugar (sucrose) and salt (sodium chloride) so as to provide equivalent taste impression in foods and beverages but using lower levels of addition. The World Health Organization (WHO) recommends reducing intake of salt and sugar in developed countries down to 2 g of sodium and 50 g of sugar per capita per day.

Examples of devices capable of containing and dispensing more than one liquid are seen in GB432400A, EP3033297A1, US2016114942A, EP1628885A1, CN2658077Y, EP2653405A1, CN202717089U and US2007075079A.

SUMMARY

Particular aspects and embodiments are set out in the appended claims.

Viewed from a first aspect, the present teachings can provide an apparatus for containing and dispensing liquids which enhance taste perception of tastants such as salt and sugar.

In a particular approach, there can be provided a liquid dispensing apparatus. The liquid dispensing apparatus comprises a first container configured to hold a first liquid. The first container has an opening in an end of the first container. The liquid dispensing apparatus further comprises a frustoconical-shaped container inside and attached to the first container. The frustoconical-shaped container is configured to hold a second liquid. A frustum of the frustoconical-shaped container has an opening. The frustum of the frustoconical-shaped container is proximate to the end of the first container and the opening in the frustoconical-shaped container has a smaller cross-sectional area than the opening in the first container. The frustoconical-shaped container separates the first liquid from the second liquid. When the first and the second liquids are poured from the apparatus, the first liquid flows through the opening in the first container, the second liquid flows through the opening in the frustoconical-shaped container and the opening in the first container, such that the first liquid begins to exit the opening in the first container before the second liquid begins to exit the opening in the first container. Thereby, a liquid dispensing apparatus is provided that can be used to sequentially dispense first and second liquids having differing tastant concentrations for consumption by a user in a manner perceived by the user as a single continuous sip from the apparatus.

BRIEF DESCRIPTION OF THE DRAWINGS

Various example embodiments will now be described in detail by way of example only with reference to the following drawings.

DETAILED DESCRIPTION

Figure 1:
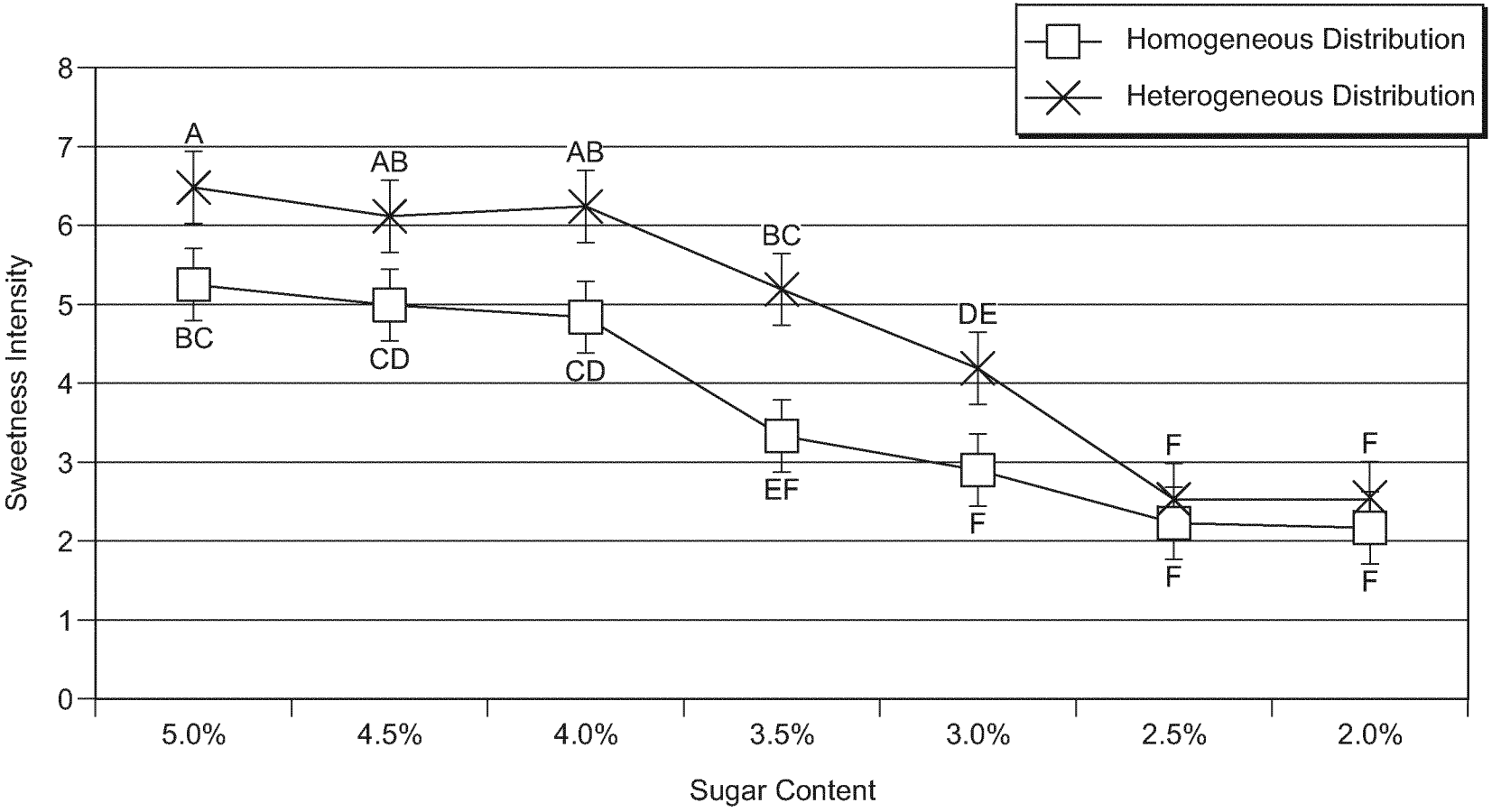
FIG. 1 is a graph of sweetness intensity vs sugar content for the enhancement of sweetness using heterogeneously distributed sucrose in a single sip.

The present disclosure relates to a liquid dispensing apparatus configured to hold and dispense multiple liquids having different tastant properties for dispensing the liquids for a user, such as a consumer. The liquids may together form a beverage for consumption (i.e. consumable) by a user. The liquids may therefore be thought of as first and second portions of the beverage. The beverage formed by the liquids may be any drink, for example a drink typically consumed hot, such as tea, coffee, hot chocolate, or soup, or a drink typically consumed cold such as iced tea, fruit juice, drinking yoghurt or milk. The beverage may be a non-carbonated beverage. Either or both of the liquids may include a neutraceutical liquid and/or a pharmaceutical liquid. The beverage may be a non-alcoholic beverage. The beverage may comprise less than 150 food calories per serving, for example less than 150 food calories per 33 cL. The beverage may comprise less than 100 food calories per serving, for example less than 100 food calories per 33 cL. The beverage may comprise less than 40 food calories per serving, for example less than 40 food calories per 33 cL.

The differing tastant properties as between the first and second liquids may be provided by either one or both of the liquids containing an amount or a relatively differing amount of a tastant. The tastant may be sweet, salty, bitter, umami, sour or have flavour. The tastant may comprise more than one component, for example a salty tastant may consist of potassium chloride and ammonium chloride. The ratio of the concentration of tastant in the first liquid to the overall concentration of tastant in the beverage may be between 3:1 and 1.1:1. For example, the first liquid may contain a tastant absent, present in smaller quantities, or present in a relatively differing amount in the second liquid, which may be applicable for tastants seen as generally positive by a user, whereas the first liquid may have an absence or reduced quantity of a tastant seen as generally negative by a user. In the context of the current invention, two liquids containing "relatively differing" amounts of tastant may refer to the two liquids having concentrations of the tastant differing by at least 5%, for example at least 10%, for example at least 20%, for example at least 30%, for example at least 40%, for further example at least 50%.

Part of the first and second liquids being consumable together allows a single sip of the combined beverage to comprise both liquids. The total volume of the first and second liquids dispensed from the liquid dispensing apparatus in one dispensing action may therefore be less than or equal to a natural sip volume. A natural sip volume may vary between users based upon factors such as gender, age, vessel size, cup vs. straw sipping, and sequence effects, but may be considered to be approximated by a figure of around 30 ml (see, for example, Dysphagia. 2003 Summer; 18(3):196-202). As discussed further below, various examples of the present approach provide that the liquid dispensing apparatus may dispense the liquids in such manner that a single use of the liquid dispensing apparatus dispenses the entire volume of the first and second liquids such that the user consumes the entire beverage volume as a single sip. This may exceed at natural sip volume as a user may be familiar with swallowing the entire content from a relatively small container as a single volume of drink rather than consuming a number of smaller sips from a much larger volume of beverage.

To facilitate the differential delivery of the first and second liquids having the differing tastant content, the liquid dispensing apparatus is configured to provide that the first liquid is dispensed substantially before the second liquid. As discussed further below, there may be an overlap between ending dispensing of the first liquid and starting the dispensing of the second liquid. By the liquid dispensing apparatus performing in this manner it is provided that the liquid dispensing apparatus is able to provide a beverage or other liquid to the user in accordance with the following taste perception principles. When a liquid containing a tastant contacts the tongue before liquid without a tastant, the overall taste impression is strongly influenced by the concentration of tastant in the first liquid to encounter the tongue.

The following 3 examples provide experimental data relating to the sensory perception of sweetness and bitterness in single and multiple sips.

Example 1

Enhancement of Sweetness Using Heterogeneously Distributed Sucrose in a Single Sip A trained panel (n=12) was used to capture, through quantitative descriptive analysis, the sweetness of different samples using packaging such as a liquid dispensing apparatus as described herein. A base typical milk chocolate product was used in this example.

The Homogenous samples contained semi-skimmed milk with Y g per liter of sucrose and 40 g per liter of cocoa powder (4%), and both chambers (which could be referred to or considered as first and second containers) of the packaging were filled with this liquid composition. The Heterogeneous samples contained semi-skimmed milk with 2 times Yg per liter of sucrose and 40 g per liter of cocoa powder (4%) in the external chamber of the packaging and semi-skimmed milk 0 g per liter of sucrose (0%) and 40 g per liter of cocoa powder (4%) in the internal chamber of the packaging. Overall, the Heterogeneous samples contained semi-skimmed milk with Yg per liter of sucrose (10%) and 40 g per liter of cocoa powder (4%), just like the Homogenous samples.

Y was varied from 50 g per liter down to 20 g per liter, in decrements of 5 g per liter, leading to seven Heterogeneous and seven Homogenous samples, all described for sweetness by the trained sensory panel. For all Y sucrose content between 50 g per liter and 30 g per liter, the Heterogeneous sample was perceived as more intense than the Homogenous sample of the same concentration. The results are illustrated in FIG. 1, where two samples which are statistically different do not share the same letters. The statistical significance of the differences is visualized in FIG. 1 by displaying the error bars representing the Fisher's least significant difference (LSD) post-hoc multiple comparison analysis computed for factors with an individual error rate of 0.05 (equivalent to a 95% confidence level) (Cl).

This sweetness enhancement can also be used to reduce sucrose content, without modifying perceived sweetness, since for example the Heterogeneous sample (Y=35 g per liter=3.5%) is perceived as sweet as the Homogenous sample (Y=50 g per liter=5%), corresponding to a 30% sucrose reduction.

Example 2

Bitterness Masking Using Heterogeneously Distributed Caffeine in a Single Sip A trained panel (n=12) was used to capture, through quantitative descriptive analysis, the bitterness of different samples using the described packaging. A base typical milk chocolate product was used in this example.

The samples contained semi-skimmed milk with sucrose at 50 g per liter (5%), 40 g per liter of cocoa powder (4%) and either:

- 0 g per liter of caffeine in both chambers (Reference sample);
- 0.4 g per liter of caffeine in both chambers (Homogenous Bitter);
- 0.8 g per liter of caffeine in the external chamber (Heterogeneous Bitter OUT);
- 0.8 g per liter of caffeine in the internal chamber (Heterogeneous Bitter IN).

Figure 2:
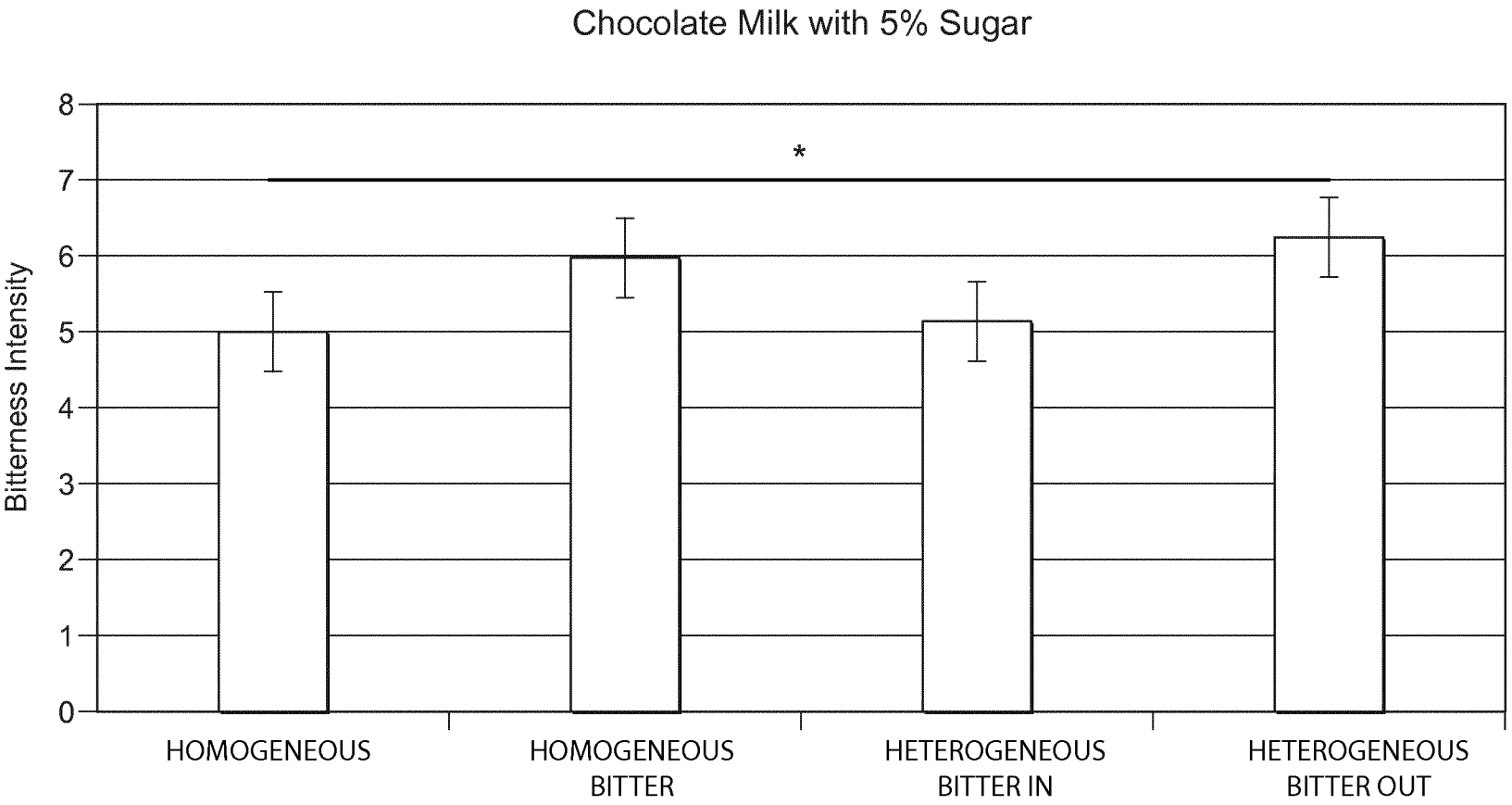
FIG. 2 is a graph of bitterness intensity for different samples of distributed caffeine in a single sip.

The results in FIG. 2 show that the samples ranked in bitterness intensity in the following order: Reference=Heterogeneous Bitter IN<Homogenous Bitter=Heterogeneous Bitter OUT. This demonstrates that the bitterness of caffeine can be reduced to the same level as the Reference sample not containing caffeine when the caffeine is located in the inner chamber (or container).

Example 3

Enhancement of Sweetness Using Heterogeneously Distributed Sucrose in a Multiple Sip Container (Which May be Considered as a Vessel Having Two Containers or Chambers to Hold the Different Samples)

A trained panel (n=12) was used to capture, through quantitative descriptive analysis, the sweetness of different samples using the described packaging. A base typical milk chocolate product was used in this example.

The Reference samples contained semi-skimmed milk with 50 g per liter of sucrose (5%) and 40 g per liter of cocoa powder (4%), and both chambers of the packaging were filled with this liquid composition. A negative control reduced in sucrose by 25% contained semi-skimmed milk with 37.5 g per liter of sucrose (3.75%) and 40 g per liter of cocoa powder (4%), and both chambers of the packaging were filled with this liquid composition. The Heterogeneous samples contained semi-skimmed milk with 75 g per liter of sucrose (7.5%) and 40 g per liter of cocoa powder (4%) in the first delivery chamber of the packaging and semi-skimmed milk with 0 g per liter of sucrose (0%) and 40 g per liter of cocoa powder (4%) in the second delivery chamber of the packaging. Overall, the Heterogeneous samples contained semi-skimmed milk with 37.5 g per liter of sucrose (3.75%) and 40 g per liter of cocoa powder (4%), just like the Homogenous samples.

8 packaging prototypes containing 20 ml each (10 ml for each delivery chamber) were used to deliver 160 ml of homogenous reference, homogenous negative control with a 25% reduction of sucrose or heterogeneous prototype with 25% reduction of sucrose.

Figure 3:
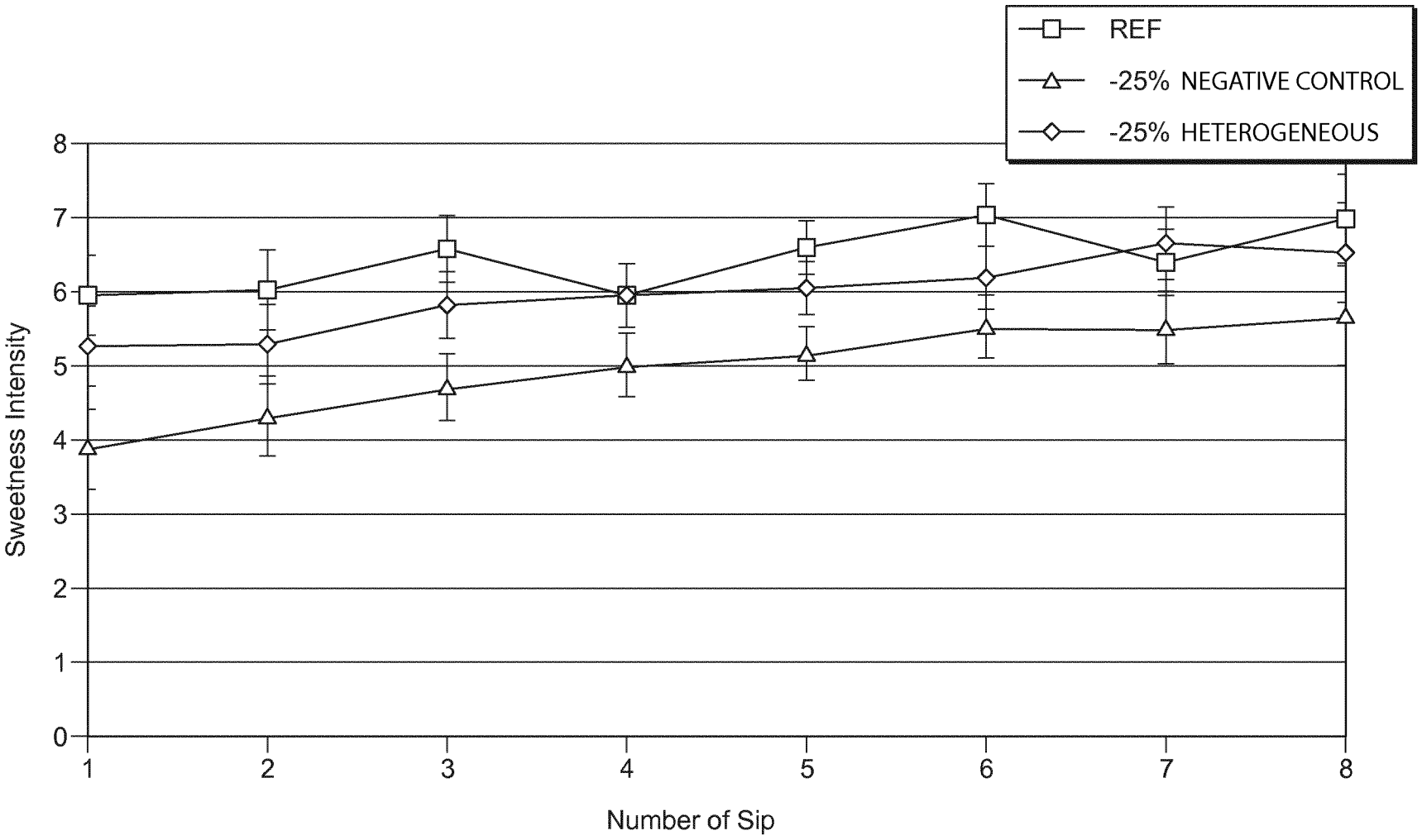
FIG. 3 is a graph of sweetness intensity vs number of sips for the enhancement of sweetness using heterogeneously distributed sucrose in a multiple sip container.

The results in FIG. 3 show that, along the 8 consecutive sips corresponding to the normal drinking behavior of a 160 ml beverage, the heterogeneous prototype is found to be not significantly less sweet than the full sugar reference, whilst the homogenous negative control with 25% less sucrose was found significantly less sweet than the reference.

Various examples of liquid dispensing apparatus and use thereof to provide delivery of first and second liquids as outlined above are now discussed with reference to FIGS. 4 to 8.

Figure 4:
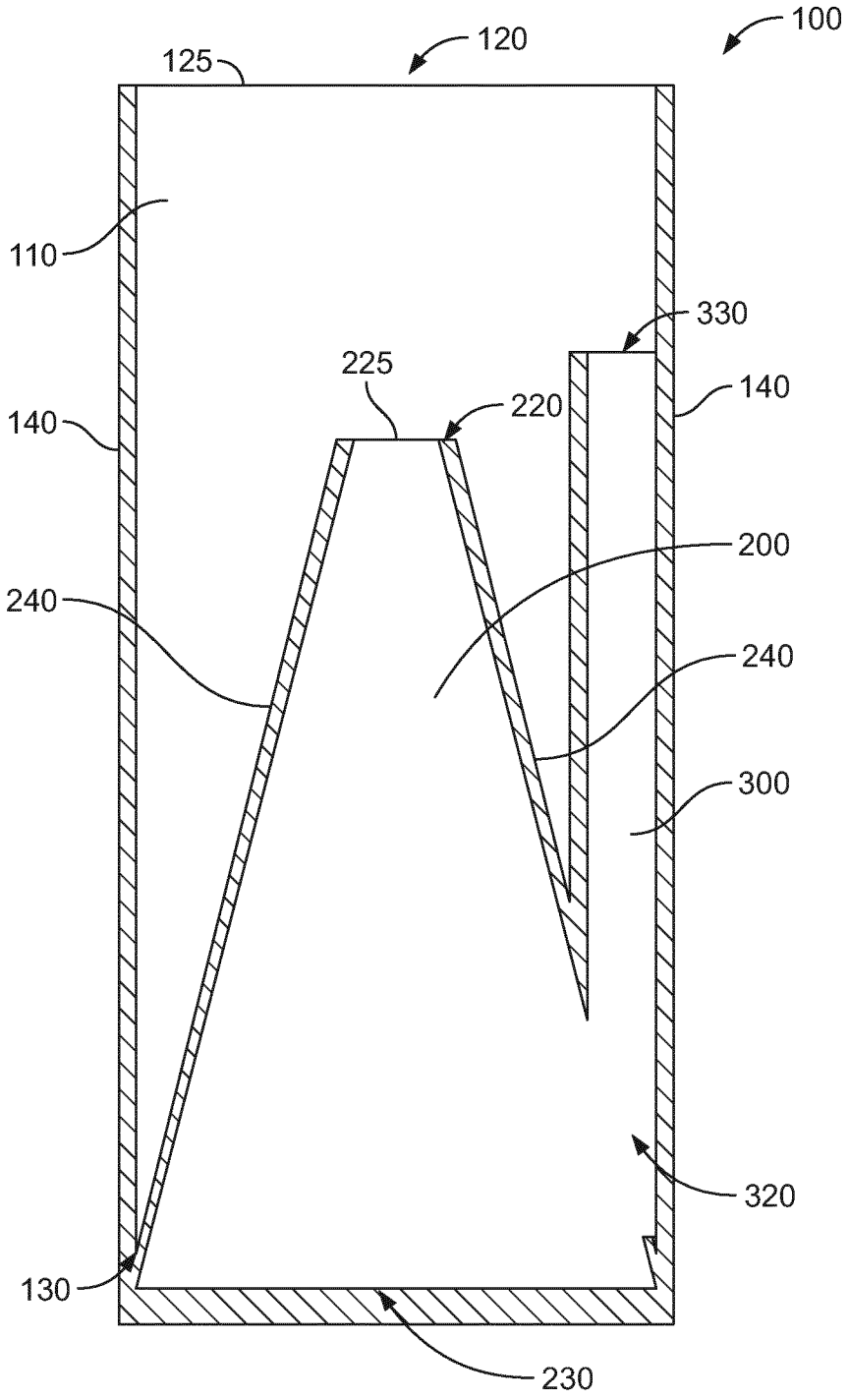
FIG. 4 is a schematic cross-section view of an example liquid dispensing apparatus.

FIG. 4 is a schematic cross-section view of an example liquid dispensing apparatus 100. The liquid dispensing apparatus 100 comprises a first container 110 configured to hold a first liquid. The first container 110 has a first end 120 and a second end 130 opposite the first end 120. In the embodiment illustrated in the FIG. 4, the first end 120 is at the top of the first container 110 and the second end is at the bottom of the first container 110. The first container 110 has one or more sidewalls 140 forming an external surface of the first container 110 and the liquid dispensing apparatus 100. The first container 110 of the presently illustrated example is circular in cross-section. In alternative examples, the first container 110 may be oval, triangular or hexagonal in cross-section or any other suitable shape with the number of sidewalls 140 being dependent on the cross-sectional shape of the first container 110. Although the sidewalls 140 of the present example as shown in FIG. 4 are illustrated as being substantially parallel, in other examples the sidewalls 140 may taper inwards or outwards towards the first end 120. Alternatively or additionally, the sidewalls 140 may be curved in one or more directions.

The first end 120 of the first container 110 has an opening 125. In the present example, as illustrated in FIG. 4, the opening 125 corresponds to substantially the entire cross-sectional area of the first end 120. In alternative examples, the opening 125 may correspond to only a portion of the cross-sectional area of the first end 120, for example 10% or less, 25%, 50%, 75%, 90% or greater. In implementations where the opening 125 corresponds to less than all of the entire cross-sectional area of the first end 120, the opening 125 may be substantially in the middle of the first end 120, or it may be offset towards a side of the first end 120. The opening 125 in the first container 110 may be circular, oval, hexagonal or triangular in cross-section, or any other suitable shape to permit dispensing of liquid from within the liquid dispensing apparatus. The opening 125 may have the same or a different cross-sectional shape to the first container 110.

The liquid dispensing apparatus 100 of the present example also comprises a frustoconical-shaped container 200. The frustoconical-shaped container 200 is inside and attached to the first container 110. The frustoconical-shaped container 200 is configured to hold a second liquid. The frustoconical-shaped container 200 has a frustum 220 at one end of the frustoconical-shaped container 200. In other words, the frustum 220 is the surface of the frustoconical-shaped container 200 along which a cut would have been made to remove a portion of the complete cone or pyramid, thereby making it frustoconical in shape. The frustum 220 is proximate to the first end 120 of the first container 110. In the present example as illustrated in FIG. 4, frustum 220 of the frustoconical-shaped container 200 is entirely contained within the first container 110. In other examples, the frustum 220 of the frustoconical-shaped container 200 may lie substantially within the same plane as the first end 120 of the first container 110.

The frustoconical-shaped container 200 has a second end 230 distal to the first end 120 of the first container 110. In the present example, as illustrated in FIG. 4, the distal end 230 of the frustoconical-shaped container 200 is substantially the same as the second end 130 of the first container 110 such that the cross-sectional area the distal end of the frustoconical-shaped container 200 is substantially the same as the cross-sectional area of the liquid dispensing apparatus 100. In alternative examples, the distal end 230 of the frustoconical-shaped container 200 may be contained within the second end 130 of the first container 110 such that the cross-sectional area of the distal end of the frustoconical-shaped container 200 is substantially less that the cross-sectional area of the liquid dispensing apparatus.

The frustoconical-shaped container 200 has one or more sidewalls 240 forming an external surface of the frustoconical-shaped container 200. In the present example the frustoconical-shaped container 200 is circular in cross-section, matching the cross-section shape of the first container 110. In alternative examples, the frustoconical-shaped container 200 may be oval, triangular or hexagonal in cross-section or any other suitable shape with the number of sidewalls 240 being dependent on the cross-sectional shape of the frustoconical-shaped container 200. For example, the frustoconical-shaped container 200 may substantially form the shape of a triangular or square based pyramid. Also, in different examples the frustoconical-shaped container 200 may have the same or a different cross-sectional shape to the first container 110. Although the sidewalls 240 of the present example as illustrated in FIG. 4 are substantially straight, in some examples the sidewalls 240 may be curved, for example to create a dome shaped container.

The first end 220 of the frustoconical-shaped container 200 has an opening 225. As illustrated in FIG. 4, the opening 225 of the present example corresponds to substantially the entire cross-sectional area of the first end 220. In alternative examples, the opening 225 may correspond to only a portion of the cross-sectional area of the first end 220, for example 10% or less, 25%, 50%, 75%, 90% or greater. In implementations where the opening 225 corresponds to less than all of the entire cross-sectional area of the first end 220, the opening 225 may be substantially in the middle of the first end 220, or it may be offset towards a side of the first end 220.

Figure 5:
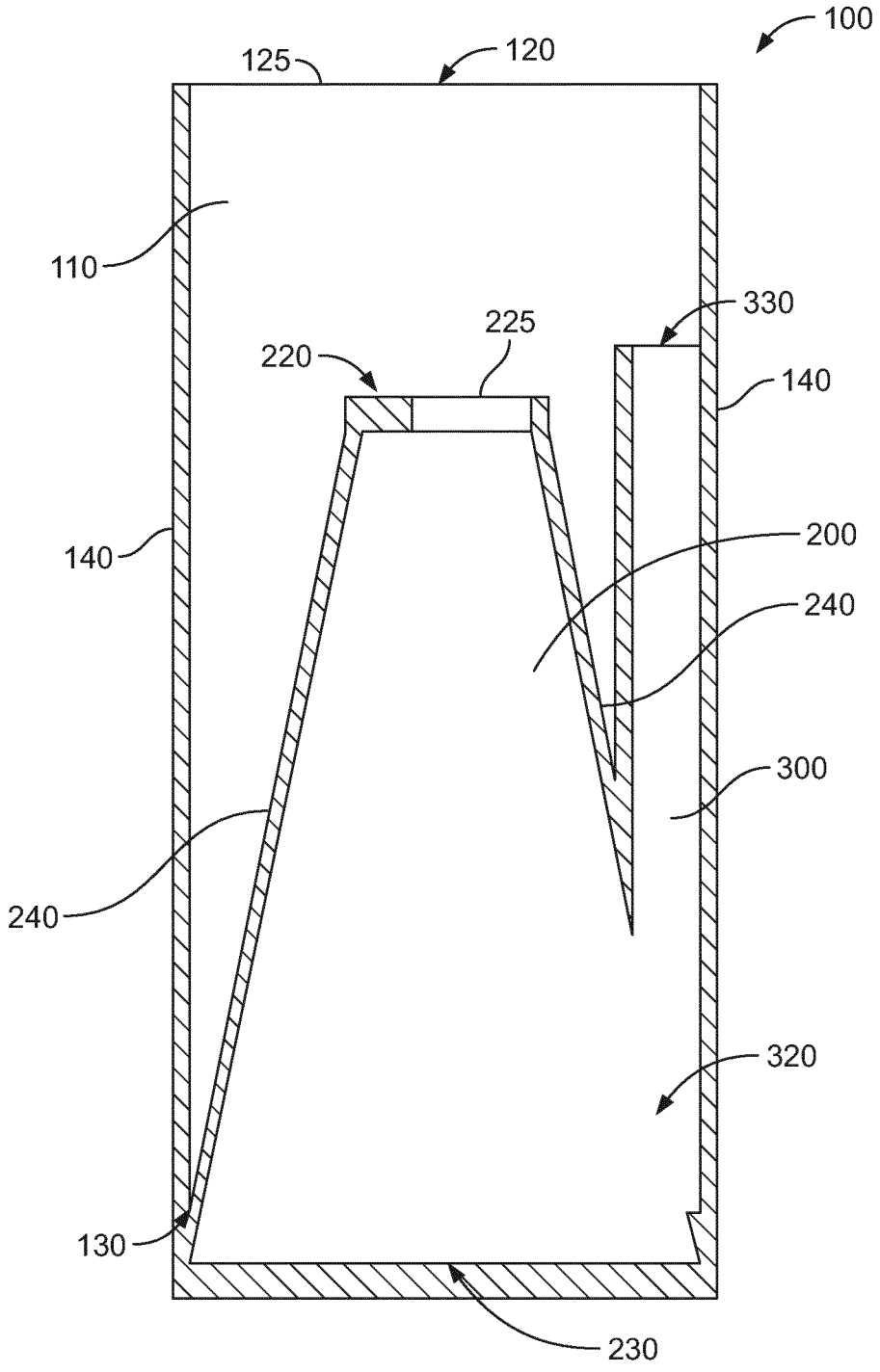
FIG. 5 is a schematic cross-section view of another example liquid dispensing apparatus.

FIG. 5 is a schematic cross-section view of another example of a liquid dispensing apparatus 100. In this example, the opening 225 corresponds to only a portion of the cross-sectional area of the first end 220 of the frustoconical-shaped container 200, for example 70-80% of the cross-sectional area of the first end 220 of the frustoconical-shaped container 200. As illustrated in FIG. 5, the opening of the present example corresponds to the option that the opening may be offset towards a side of the first end 220 of the frustoconical-shaped container 200.

Figure 6:
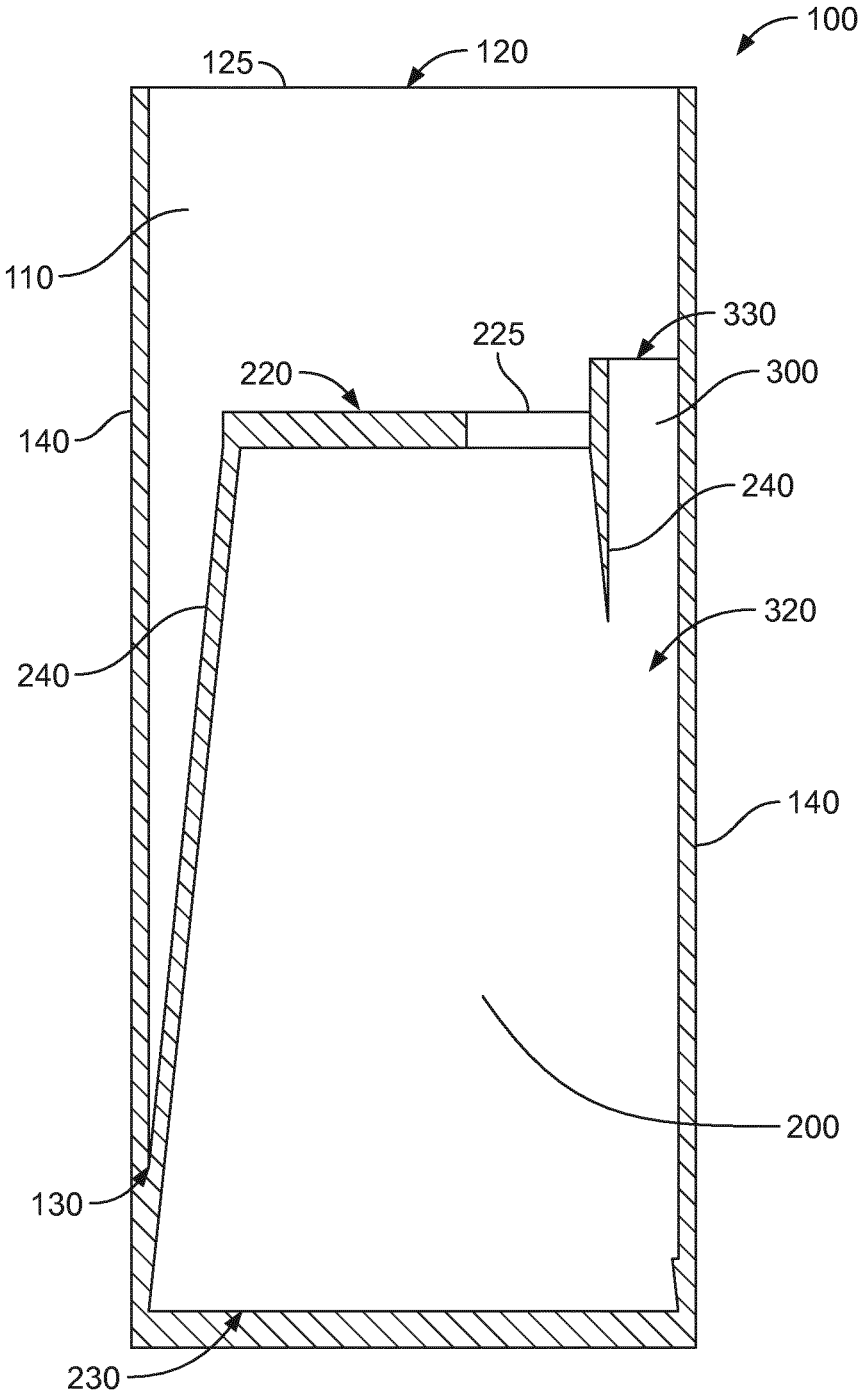
FIG. 6 is a schematic cross-section view of another example liquid dispensing apparatus.

FIG. 6 is a schematic cross-section view of another example of a liquid dispensing apparatus 100. In this example, the opening 225 covers a portion of the cross-sectional area of the first end 220 of the frustoconical-shaped container 200, for example 30-40% of the cross-sectional area of the first end 220 of the frustoconical-shaped container 200. As illustrated in FIG. 6, the opening of the present example corresponds to the option that the opening may be offset towards a side of the first end 220 of the frustoconical-shaped container 200.

Although not shown in FIG. 4, 5 or 6, the opening 225 in the frustoconical-shaped container 200 may be circular, oval, hexagonal or triangular in cross-section, or any other suitable shape to permit dispensing of the second liquid. The opening 225 of the frustoconical-shaped container 200 may have the same or a different cross-sectional shape to the frustoconical-shaped container 200.

As illustrated in FIGS. 4 to 6, in the present examples the opening 225 in the frustoconical-shaped container 200 has a smaller cross-sectional area than the opening 125 in the first container 110. The opening 225 in the frustoconical-shaped container 200 may have the same or a different cross-sectional shape to the opening 125 in the first container 110.

The frustoconical-shaped container 200 acts to separate the first liquid from the second liquid. For example, when the first container 110 contains the first liquid and the frustoconical-shaped container 200 contains the second liquid, the sidewalls 240 of the frustoconical-shaped container 200 prevent the first liquid from entering the frustoconical-shaped container 200 when the level of the first liquid is below the opening 225 in the frustoconical-shaped container 200.

The liquid dispensing apparatus 100 also comprises a vent 300. The vent 300 may be a hollow tube with a circular, oval or hexagonal cross-section or any other suitable cross-sectional shape to permit venting of the frustoconical-shaped container 300. The vent 300 has a first end 320 and a second end 330 opposite the first end 320. The first end 320 of the vent is connected to the frustoconical-shaped container 200 and the second end 330 of the vent 300 is open to allow air to flow through the vent 300 into the frustoconical-shaped container 200. Although the vent 300 of the example shown in FIG. 4 has a substantially constant cross-sectional area, in other examples the vent 300 may taper towards the first end 320 or the second end 330 of the tube. Also, the tube may be curved, for example extending upwardly in a helical shape towards the first end 120 of the first container 110. Additionally, the vent may include one or more constrictions in the internal profile of the tube such that the tube may have different internal and external cross section area, at least at some positions along the length of the tube.

In other examples, the vent may be omitted such that any necessary venting of the frustoconical-shaped container may be provided by air passing through the opening at the frustum.

As illustrated in FIG. 4, the second end 330 of the vent 300 in the present example is generally proximate to the opening 125 in the first end 120 of the first container 110. As shown the second end 330 of the vent 300 is located, in the direction between the first end 120 and the second end 130 of the first container, between the first end 120 of the first container and the frustum 220 of the frustoconical-shaped container 200. In other examples, the second end 330 of the vent 300 may lie substantially within the same plane as the first end 120 of the first container 110. Alternatively or in addition, the second end 330 of the vent 300 may lie substantially within the same plane as the frustum 220 of the frustoconical-shaped container 200. The second end 330 of the vent 300 may be entirely contained within the first container 110 as in the example shown in FIG. 4. As illustrated in FIG. 4, the second end 330 of the vent 300 may be closer to the first end 120 of the first container 110 than the frustum 220 of the frustoconical-shaped container 200. As illustrated in FIG. 4, the vent 300 may be attached to a sidewall 140 of the first container 110. In alternative examples, the vent 300 may be separated from the sidewalls 140 of the first container 110 by a gap.

In other alternative examples, the vent 300 may pass through one or more sidewalls 140 of the first container 110 such that the second end 330 of the vent is at or beyond an exterior surface of the first container 110.

Figure 7:
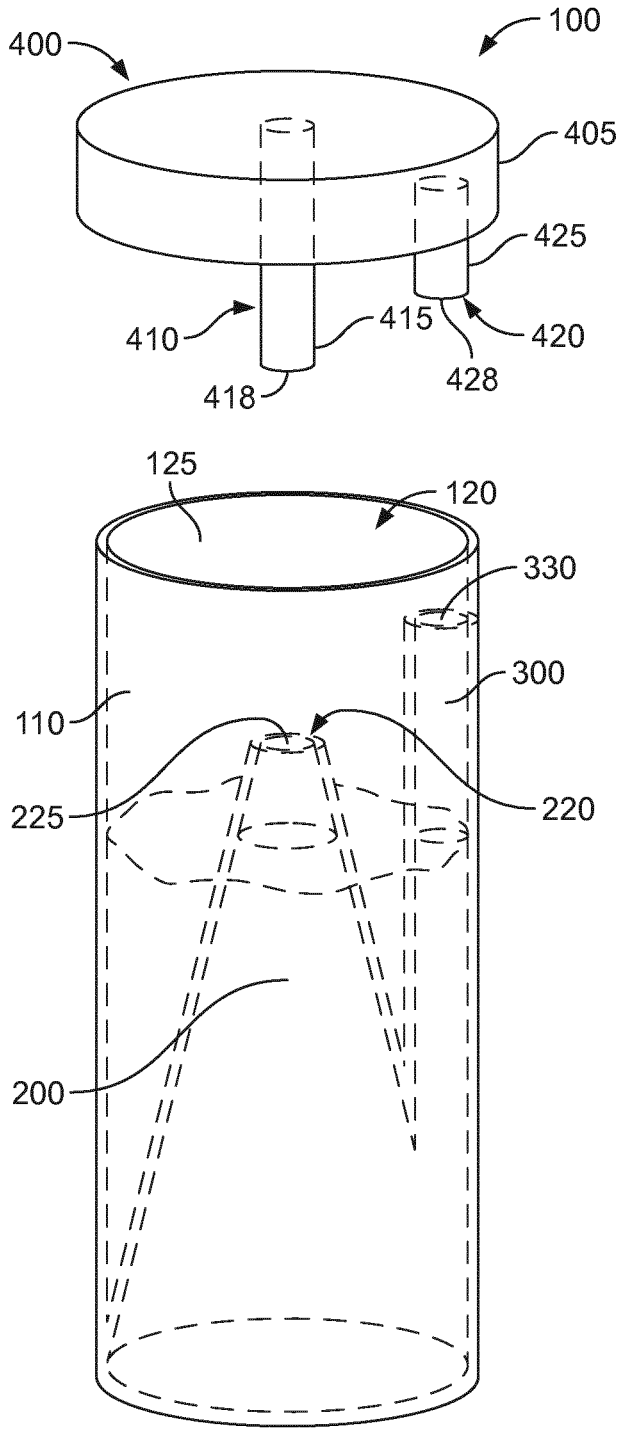
FIG. 7 is a schematic perspective view of an example liquid dispensing apparatus.

FIG. 7 is a schematic perspective view of the example liquid dispensing apparatus 100 of FIG. 4. In the illustrated example, the liquid dispensing apparatus 100 also comprises a cap 400. The cap 400 is configured to seal the opening 125 in the first end 120 of the first container 110, thereby preventing liquid from flowing out of the first container 110 and the liquid dispensing apparatus 100. In the present example, the cross-sectional shape and cross-sectional area of an outer surface 405 of the cap 400 are substantially the same as that of the opening 125 in the first end 120 of the first container 110 such that the cap 400 can slide inside the opening 125 in the first end 120 of the first container 110 and provide a fluid tight seal by an interference fit between the outer surface 405 of the cap 400 and the opening 125 in the first end 120 of the first container 110. Alternatively, the cross-sectional area of the cap may be larger than that of the first end 120 of the first container 110. For example, the cross-sectional shape and cross-sectional area of an inner portion of the cap 400 may be substantially the same as that of the outside of the first end 120 of the first container 110 such that the cap 400 can pass over and outside the first end 120 of the first container 110 and provide a fluid tight seal by an interference fit between the inner portion of the cap 400 and the outside of the first end 120 of the first container 110. In this example, the outside of the cap 400 may have a different cross-sectional shape to that of the opening 125 in the first end 120 of the first container 110 and/or different cross-sectional shape to that of the first container 110. In further alternatives, the cap 400 may be configured to screw onto the first end 120 of the first container 110.

One or more external surfaces 405 of the cap 400 may have ridges, knurls, indents or any other suitable surface texture or pattern to assist a user in gripping the cap 400 and making it easier to remove the cap 400 from the first container 110.

The cap 400 may also comprise one or more security features, such as a taper evident tab or child resistant mechanism in order to prevent the cap from being inadvertently removed from the first container.

The cap 400 of the present example is further configured to seal the opening 225 in the frustum 220 of the frustoconical-shaped container 200 and the second end 330 of the vent 300.

In the illustrated example, the cap 400 may comprise a first element 410 (which may be termed a chimney or similar) which extends from the cap 400. The cross-sectional shape and cross-sectional area of an outer surface 415 of the first chimney 410 may be substantially same as that of the opening 225 in the frustum 220 of the frustoconical-shaped container 200 such that the first chimney 410 can slide inside the opening 225 in the frustum 220 of the frustoconical-shaped container 200 and provide a fluid tight seal by an interference fit between the outer surface 415 of the first chimney 410 and the opening 225 in the frustum 220 of the frustoconical-shaped container 200.

In the present example, the cap 400 also comprises a second element 420 (which again may be termed a chimney or similar hollow) which extends from the cap 400. The cross-sectional shape and cross-sectional area of an outer surface 425 of the second chimney 420 may be substantially same as that of second end 330 of the vent 300 such that the second chimney 420 can slide inside the second end 330 of the vent 300 and provide a fluid tight seal by an interference fit between the outer surface 425 of the second chimney 420 and the second end 330 of the vent 300.

Alternatively, the first chimney 410 may be of a length such that, when the cap 400 seals the opening 125 in the first end 120 of the first container 110, the end 418 of the first chimney 410 abuts the frustum 220 of the frustoconical-shaped container 200, thereby sealing the opening 225 in the frustum 220 of the frustoconical-shaped container 200. Alternatively or in addition to, the second chimney 420 may be of a length such that, when the cap 400 seals the opening 125 in the first end 120 of the first container 110, the end 428 of the second chimney 420 abuts the second end 330 of the vent 300, thereby sealing second end 330 of the vent 300. The first chimney 410 and/or the second chimney 420 may be hollow, or may be solid bodies.

In further examples alternative closures may be provided, such as a sealing film or foil, or an insertable plug.

Figure 8A:
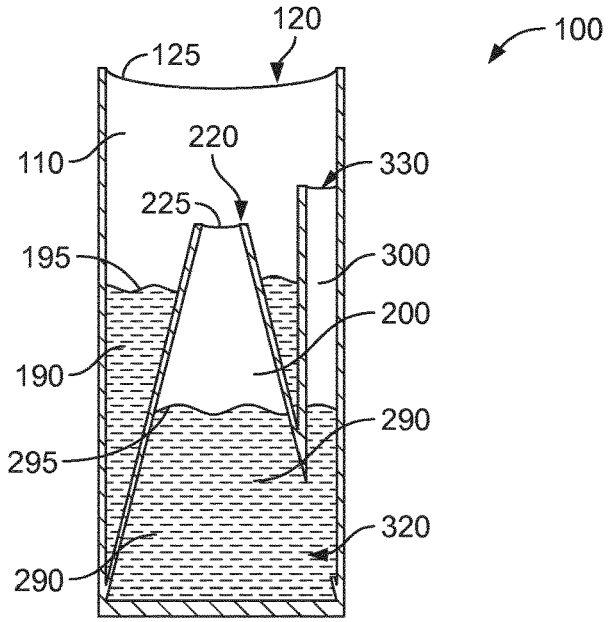
FIGS. 8A-F are a series of schematic cross-sections of an example liquid dispensing apparatus in use.

FIGS. 8A-F are a series of schematic cross-section views of an example liquid dispensing apparatus in use to dispense liquid. FIGS. 8A-F show the delivery of a first liquid 190 and a second liquid 290 out of the liquid dispensing apparatus 100. FIG. 8A shows the liquid dispensing apparatus 100 of FIG. 4, although it will be appreciated that the effect of the apparatus when in use may be achieved with any of the examples described above, for example those illustrated in FIGS. 5 and 6.

The liquid dispensing apparatus 100 shown in FIGS. 8A-F may have been provided with a cap or other closure 400 as described above with reference to FIG. 7. In this case, the cap 400 is designed to be removed prior to use.

FIG. 8A shows the first container 110 containing a first liquid 190 and the frustoconical-shaped container 200 containing a second liquid 290. The fluid level 195 of the first liquid 190 is below the frustum 220 of the frustoconical-shaped container 200 such that the frustoconical-shaped container 200 separates the first liquid 190 from the second liquid 290. The volume of the first liquid 190 in the first container 110 may be less than, greater than or equal to the volume of the second liquid 290 in the frustoconical-shaped container 200. The choice of relative proportions of the different liquids depends upon, for example, the relative tastants in the liquids and/or other ingredients in the liquids which the liquid dispensing apparatus is used to deliver to a user. In the illustrated example, the volume of the first liquid 190 in the first container 110 is less than the volume of the second liquid 290 in the frustoconical-shaped container 200.

Figure 8B:
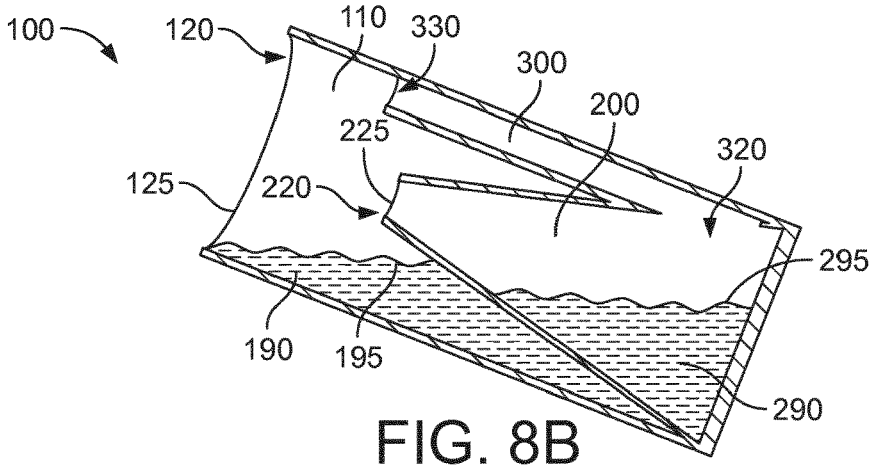

FIG. 8B shows the liquid dispensing apparatus 100 of FIG. 8A having been rotated through an initial angle in readiness to commence pouring of the first liquid 195 and the second liquid 295 from the liquid dispensing apparatus 100. The fluid level 195 of the first liquid 190 is at or slightly below the opening 125 in the first end 120 of the first container 110 and therefore the first liquid 190 is yet to begin to pour out of the opening 125 in the first end 120 of the first container 110. Equally, the fluid level 295 of the second fluid 290 is below the opening 225 in the frustum 220 of the frustoconical-shaped container 200 and therefore the second liquid 290 is yet to begin to pour out of the opening 225 in the frustum 220 of the frustoconical-shaped container 200.

Figure 8C:
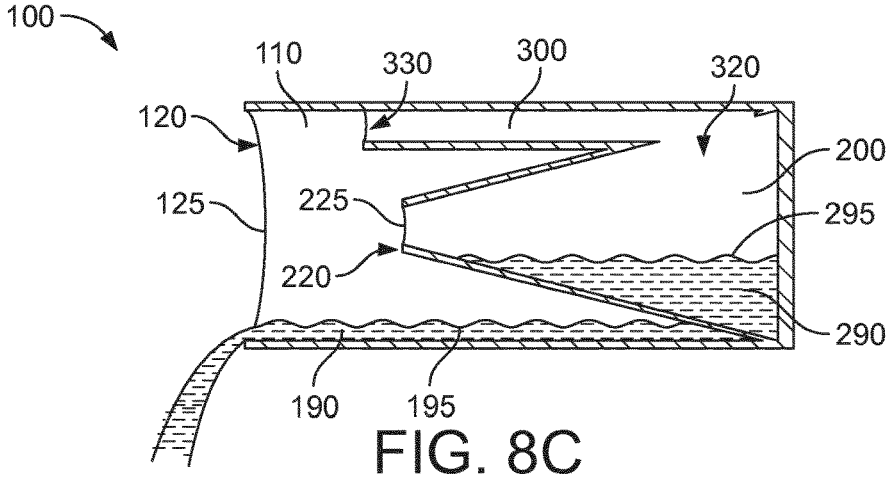

FIG. 8C shows the liquid dispensing apparatus 100 of FIG. 8B having been rotated through a greater angle. As the liquid dispensing apparatus is rotated, air is able to flow into the frustoconical-shaped container 200 via the vent 300. In other words, air is able to flow into the second end 330 of the vent 300, along the vent 300 and out of the first end 320 of the vent 300 into the frustoconical-shaped container 200.

The fluid level 195 of the first liquid 190 is above the opening 125 in the first end 120 of the first container 110, thereby allowing the first liquid 195 to flow out of the opening 125 in the first end 120 of the first container 110. The fluid level 295 of the second liquid 290 is below or at the opening 225 in the frustum 220 of the frustoconical-shaped container 200 and therefore the second liquid 290 is yet to begin to pour out of the opening 225 in the frustum 220 of the frustoconical-shaped container 200. In other words, when the liquid dispensing apparatus 100 is rotated in order to pour the first liquid 190 and the second liquid 290 out of the liquid dispensing apparatus 100, the first liquid 190 begins to exit the opening 125 in the first end 120 of the first container 110 before the second liquid 290 begins to exit the opening in the first container. As illustrated in FIG. 8C, the cross-sectional area of the opening 225 in the frustum 220 of the frustoconical-shaped container 200 is smaller that the cross-sectional area of the opening 125 in the first end 120 of the first container 110, thereby requiring the liquid dispensing apparatus to be rotated through a large angle before the second liquid can flow out of the opening 225 in the frustum 220 of the frustoconical-shaped container 200 and the opening 125 in the first end 120 of the first container 110.

Figure 8D:
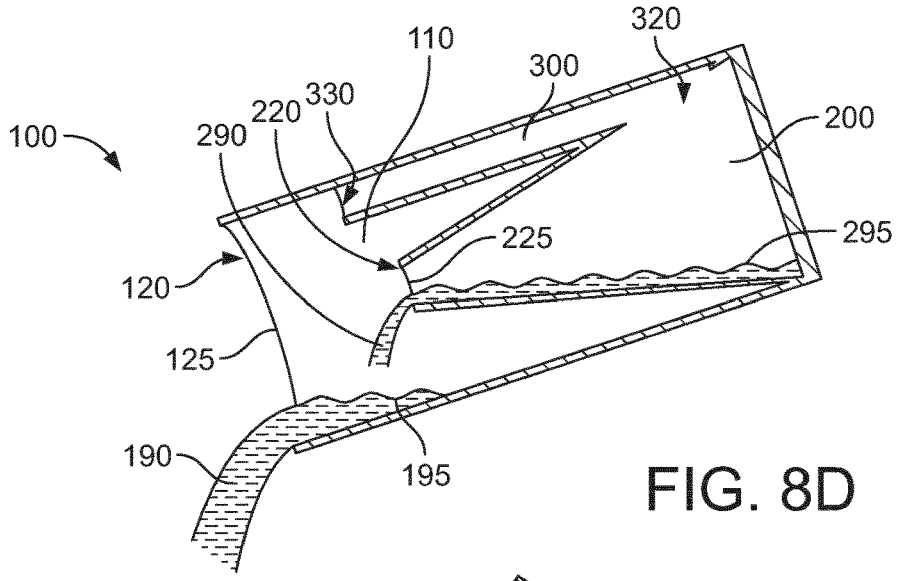

FIG. 8D shows the liquid dispensing apparatus 100 of FIG. 8C having been rotated through a greater angle. In this case, the fluid level 195 of the first liquid 190 is still above the opening 125 in the first end 120 of the first container 110, therefore the first liquid 195 continues to flow out of the opening 125 in the first end 120 of the first container 110. The fluid level 295 of the second liquid 290 is above the opening 225 in the frustum 220 of the frustoconical-shaped container 200, thereby allowing the second liquid 290 to flow out of the opening 225 in the frustum 220 of the frustoconical-shaped container 200. In the case illustrated in FIG. 8D, the second liquid 290 has begun to flow out of the opening 225 in the frustum 220 of the frustoconical-shaped container 200 and into the first container 110, but the second liquid 290 is yet to begin to flow out of the opening 125 in the first end 120 of the first container 110. The second liquid 290 which flows into the first container 110 may mix with any remaining first liquid 190 in the first container 110. Alternatively, the first liquid 190 and the second liquid 290 may be immiscible.

Figure 8E:
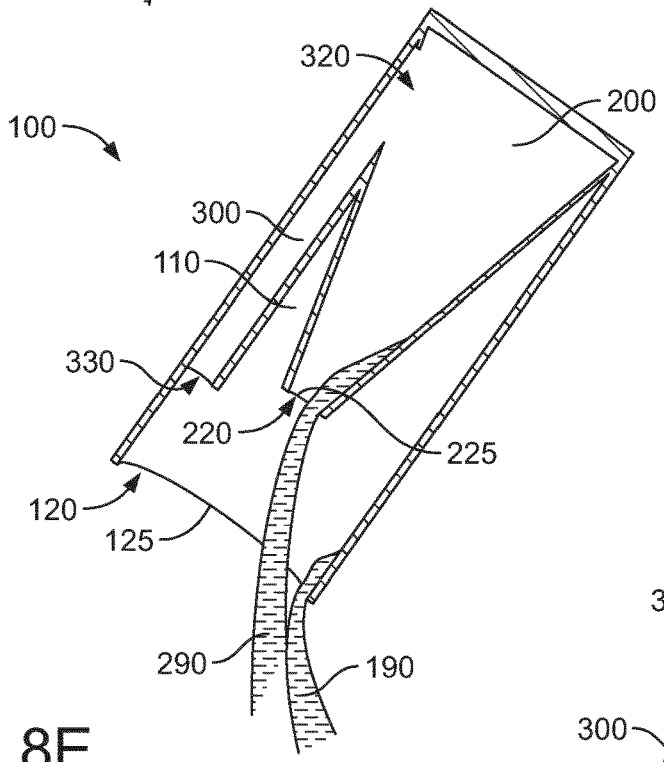

FIG. 8E shows the liquid dispensing apparatus 100 of FIG. 8D having been rotated through a greater angle. In this case, the first liquid 190 continues to flow out of the opening 125 in the first end 120 of the first container 110, whilst the liquid dispensing apparatus 100 is now rotated sufficiently to allow the second liquid 290 to flow out of the opening 225 in the frustum 220 of the frustoconical-shaped container 200 and out of the opening 125 in the first end 120 of the first container 110.

As illustrated in FIGS. 8A-F, the liquid dispensing apparatus 100 may be configured such that, when the first liquid 190 and the second liquid 290 are poured from the liquid dispensing apparatus 100, the second end 330 of the vent 300 is not below the fluid level 195 of the first liquid 190, thereby ensuring that air is always able to flow into the frustoconical-shaped container 200 via the vent 300.

In the embodiment illustrated in FIG. 8E, the first liquid 190 continues to flow out of the opening 125 in the first end 120 of the first container 110 whilst the second liquid 290 begins to flow out of the opening 125 in the first end 120 of the first container 110. In other words, the delivery of the first liquid 190 out of the liquid dispensing apparatus 100 overlaps with the delivery of the second liquid 290 out of the liquid dispensing apparatus 100. In an alternative embodiment, the first liquid 190 may be depleted from the liquid dispensing apparatus 100 before the second liquid 290 begins to flow out of the opening 125 in the first end 120 of the second container 110. In other words, the delivery of the first liquid 190 out of the liquid dispensing apparatus 100 may be completed before the delivery of the second liquid 290 out of the liquid dispensing apparatus 100 commences. In dependency upon the tastant properties of the liquids and the tastant sensitivity of a tongue, the liquid dispensing apparatus is configured to cause the first liquid 190 be depleted from the liquid dispensing apparatus 100 a very short period of time after the second liquid 290 begins to flow out of the opening 125 in the first end 120 of the first container 110, thereby minimising the overlap between the delivery of the first liquid 190 and the delivery of the second liquid 290, while also avoiding a gap between delivery of the first and second liquids.

Any of these embodiments may be achieved by controlling the volume of the first liquid contained in the first container and the second liquid contained in the frustoconical-shaped container 200 prior to commencing delivery of the first liquid 190 and the second liquid 290 from the liquid dispensing apparatus. Alternatively or in addition, the viscosity of the second liquid 290 may be selected such as to ensure that the first fluid 190 flows out of the liquid dispensing apparatus 100 quicker then the second liquid 290. For example, the second fluid 290 may have a higher viscosity than the first liquid 190, for example less than twice as high, 10 times a high, 100 times as high or greater.

The cross-sectional area of the vent 300 and/or the cross-sectional area of the opening 225 in the frustum 220 of the frustoconical-shaped container 200 may be sized such as to inhibit the flow of the second liquid 290, thereby ensuring that the first liquid 190 begins to exit the opening 125 in the first end 120 of the first container 110 before the second liquid 290 begins to exit the opening 125 in the first end 120 of first container 110, and/or before the second liquid 290 begins to exit the opening 225 in the frustum 220 of the frustoconical-shaped container 200. Equally, the cross-sectional area of the vent 300 and/or the cross-sectional area of the opening 225 in the frustum 220 of the frustoconical-shaped container 200 may be sized such as to inhibit the flow of the second liquid 290, thereby ensuring that the first liquid 190 may be depleted from the liquid dispensing apparatus 100 before the second liquid 290 begins to flow out of the opening 125 in the first end 120 of the first container 110. This provides that, even when the liquid dispensing apparatus is rapidly rotated, or the cap is removed whilst the container is held at an angle, the first liquid will always begin to exit the opening 125 in the first end 120 of the first container 110 before the second liquid 290 begins to exit the opening 125 in the first end 120 of first container 110.

Figure 8F:
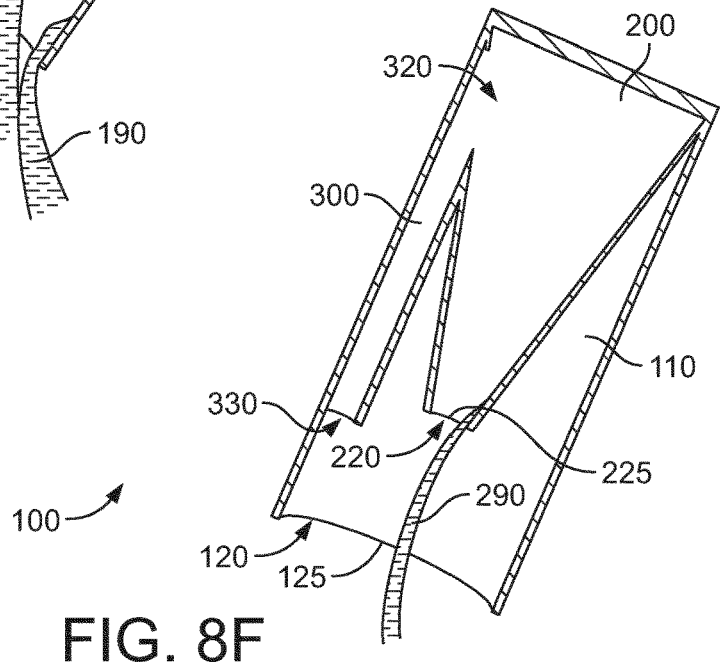

FIG. 8F shows the liquid dispensing apparatus 100 of FIG. 8E having been rotated through a greater angle. In this case, the first liquid 190 has already been depleted from the first container 110 whilst the second liquid continues to flow out of the opening 225 in the frustum 220 of the frustoconical-shaped container 200 and out of the opening 125 in the first end 120 of first container 110.

As will therefore be appreciated, the liquid dispensing apparatus of the present examples is configured to dispense substantially the entire content of each of the first and second liquids in a single dispensing (pouring) operation. Thus the liquid dispensing apparatus of the present examples may be considered to be a single-dispense beverage container (although it may be refillable). Accordingly, the liquid dispensing apparatus of the present examples may be suitable for use in providing concentrated or small volume beverages, such as drinking yogurt, nutrient supplement or nutraceutical beverages, or (re)hydration mineral beverages. The liquid dispensing apparatus of the present examples may be used for other beverages such as teas, iced teas, fruit juices or smoothies, coffees, iced coffees, milk-based drinks, soups, drinking chocolates or malt beverages.

The first container 110, the frustoconical-shaped container 200 and the vent 300 may be manufactured from a plastics material, for example a food grade plastics material. The first container 110, the frustoconical-shaped container 200 and the vent 300 may be manufactured as a single piece of plastics material, for example injection moulded, rotational moulding, or any other suitable plastics forming techniques. The first container 110, the frustoconical-shaped container 200 and/or the vent may be formed as separate containers and joined together by a suitable means, such as with an adhesive or epoxy resin. The first container 110, the frustoconical-shaped container 200 and the vent 300 may be manufactured from different materials. For example, the frustoconical-shaped container 200 may be manufactured from Polyethylene terephthalate (PET), the vent 300 may be manufactured from Polyvinyl chloride (PVC) whilst the first container 110 may be manufactured from a metal such as stainless steel, aluminium or copper. One or more of the first container 110, the frustoconical-shaped container 200 and the vent 300 maybe manufactured from a cardboard, moulded fiber or pulp with a fluid impermeable coating such as wax or a plastics material. The cap 400 may be manufactured from the same material as one or more of the first container 110, the frustoconical-shaped container 200 and the vent 300, or a different material. For example, the cap 400 may be manufactured from aluminium by turning, milling or any other suitable manufacturing process.

As discussed above, one of the first liquid 190 and the second liquid 290 may contain a tastant which is essentially absent from the other liquid, or is present in a relatively differing amount. A tastant "essentially absent" from a liquid may for example be present at a concentration below the threshold for perception of that tastant. The perception threshold varies according to the tastant; for high intensity sweeteners it is a very small quantity. A tastant "essentially absent" from a liquid may for example be present at a concentration below 10% of the $EC_{50}$ value. The $EC_{50}$ value is the concentration at which the tastant gives half the maximal response. In the situation where the tastant is sucrose, "essentially absent" may be considered concentrations below 10 mM. The composition of the first liquid 190 and the second liquid 290 may be essentially the same apart from the concentration of the tastant. For example, the first liquid 190 and the second liquid 290 may be substantially identical in terms of fats, air, proteins, macronutrients and carbohydrates, such that the first liquid and the second liquid comprise the same components in the same relative proportions apart from the presence of the tastant in one of the liquids. The first liquid 190 and the second liquid 290 may be visually the same. For example, the first liquid 190 and the second liquid 290 may have the same visual appearance, such as the colour, structure, texture, or any other obviously and directly perceivable property without tasting or smelling, such that the first liquid 190 and the second liquid 290 appear to have the same composition for users of the liquid dispensing device. The density and/or viscosity of the first liquid 190 and the second liquid 290 may be substantially the same. As will be appreciated by the skilled reader, the detection of and sensitivity to different tastants may be explained by the principle of chemesthesis.

The tastant may be sweet, salty, bitter, umami, sour or have flavour. For example, a salty tastant may consist of one or more of sodium chloride, potassium chloride and ammonium chloride. A sweet tastant may consist of one or more of glucose, sucrose, fructose or galactose.

The second liquid 290 may be a medicine, a nutraceutical or a dietary supplement. In this case, second liquid may have a bitter or sour tastant associated with the composition of the medicine, the nutraceutical or the dietary supplement. This tastant may be essential absent from the first liquid 190. When the first liquid 190 and the second liquid 290 are delivered from the liquid dispensing apparatus 100, for example into the mouth of a user, the first liquid 190 flows out of the liquid dispensing apparatus 100 before the second liquid 290. The user therefore tastes the first liquid 190 before the bitter or sour second liquid 290, given the user a more pleasant taste experience than if the second liquid 290 were delivered at the same time or before the first liquid 190.

The tastant in the beverage of the invention may comprise sodium chloride, for example the tastant may be sodium chloride. Humans have added common salt (sodium chloride) to their food for thousands of years and have grown accustomed to its taste. As a result, the most desirable saltiness profile is that obtained with sodium chloride. Sodium chloride can act to enhance the overall flavour of the food. The beverage according to the invention may contain 140 mg of sodium or less per 100 g of the total beverage. The U.S. Food and Drug Administration define meals and main dishes to be "low in sodium" if they contain 140 mg or less of sodium per 100 g.

The tastant in the beverage of the invention may comprise sucrose, for example the tastant may be sucrose or other sweetness component.

In the beverage to be dispensed from the apparatus of the present examples, part of the first liquid and the part of the second liquid may consumable together followed by another part of the first liquid and another part of the second liquid together. For example the beverage may be such that a part of the first portion may be consumable with a part of the second portion in a series of such combinations, for example a series of at least 3 combinations, for example a series of at least 5 combinations, for example series of at least 10 combinations. The beverage of the invention may be such that the majority of the second portion by volume is consumable in a series of combinations comprising (for example consisting of) part of the first portion and part of the second portion together. Such combinations can be delivered by adjusting the relative flow rates of the first and second liquids from the different containers within the apparatus so as to alter the flow overlap of the two liquids as discussed above.

The skilled person will appreciate that these embodiments are provided only by way of example, and different features from different embodiments can be combined as appropriate without departing from the spirit and scope of the present teachings. Accordingly, the scope of the presently claimed invention is to be defined by the appended claims and their equivalents.

The invention claimed is:

1. A liquid dispensing apparatus comprising:

a first container comprising an opening in an end of the first container;

a first liquid held by the first container;

a frustoconical-shaped container inside and attached to the first container, a frustum of the frustoconical-shaped container having an opening, the frustum of the frustoconical-shaped container being proximate to the end of the first container, and the opening in the frustoconical-shaped container having a smaller cross-sectional area than the opening in the first container, a second liquid, wherein the second liquid is held by the frustoconical-shaped container, and a volume of the first liquid is less than a volume of the second liquid;

the frustoconical-shaped container separates the first liquid from the second liquid;

a vent comprising a first end and a second end opposite the first end, the first end connected to the frustoconical-shaped container and the second end being open to allow air to flow through the vent into the frustoconical-shaped container; and the liquid dispensing apparatus is configured such that, when the first and the second liquids are poured from the liquid dispensing apparatus, the first liquid flows through the opening in the first container, the second liquid flows through the opening in the frustoconical-shaped container and the opening in the first container, the air flows into the frustoconical-shaped container via the vent, and the first liquid begins to exit the opening in the first container before the second liquid begins to exit the opening in the first container, one of the first liquid and the second liquid contains a tastant which is essentially absent from the other liquid or is present in a relatively differing amount, the first liquid has a concentration of the tastant, and a ratio of the concentration of the tastant in the first liquid to an overall concentration of the tastant in a beverage dispensed by the liquid dispensing apparatus is between 3:1 and 1.1:1.

2. The liquid dispensing apparatus of claim 1, wherein the tastant has a characteristic selected from the group consisting of sweet, salty, bitter, umami, sour, and combinations thereof.

3. The liquid dispensing apparatus of claim 1, comprising a cap configured to seal the opening in the end of the first container.

4. The liquid dispensing apparatus of claim 3, wherein the cap is further configured to seal the opening in the frustum of the frustoconical-shaped container and/or the second end of the vent.

5. The liquid dispensing apparatus of claim 1, wherein the cross-sectional area of the vent and/or the opening in the frustum of the frustoconical-shaped container is sized such as to inhibit a flow of the second liquid.

6. The liquid dispensing apparatus of claim 1, wherein the second end of the vent is proximate to the opening in the end of the first container.

7. The liquid dispensing apparatus of claim 1, wherein the second end of the vent is on an exterior surface of the first container.

8. The liquid dispensing apparatus of claim 1, wherein the liquid dispensing apparatus is configured such that, when the first and the second liquids are poured from the liquid dispensing apparatus, the second end of the vent is not below a fluid level of the first liquid.

9. The liquid dispensing apparatus of claim 1, wherein the liquid dispensing apparatus is configured such that, when the first and the second liquids are poured from the apparatus, the first liquid is depleted before the second liquid.

10. The liquid dispensing apparatus of claim 1, wherein the frustoconical-shaped container substantially forms a shape of a triangular or square based pyramid.

11. The liquid dispensing apparatus of claim 1, wherein the concentration of the tastant in the first liquid and a concentration of the tastant in the second liquid differ by at least 5%.

12. The liquid dispensing apparatus of claim 1, wherein the concentration of the tastant in the first liquid and a concentration of the tastant in the second liquid differ by at least 50%.

* * * * *